US006273676B1

(12) United States Patent
Brooks et al.

(10) Patent No.: US 6,273,676 B1
(45) **Date of Patent: *Aug. 14, 2001**

(54) METHOD AND ASSEMBLY FOR MASKING A FLOW DIRECTING ASSEMBLY

(75) Inventors: Robert Theodore Brooks, Killingworth; Harvey Richard Toppen, Glastonbury, both of CT (US)

(73) Assignee: United Technologies Corporation, Hartford, CT (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/298,144

(22) Filed: Apr. 23, 1999

Related U.S. Application Data

(60) Provisional application No. 60/089,664, filed on Jun. 17, 1998.

(51) Int. Cl.[7] ..... F01D 5/14; F01D 9/04; B05D 1/00

(52) U.S. Cl. ..... 415/191; 415/200; 416/62; 416/224; 416/229 A; 427/282; 427/287; 427/292; 427/448; 118/504; 118/505

(58) Field of Search ..... 416/62, 146 R, 416/224, 229 R, 229 A, 241 R, 241 A, 241 B; 415/191, 200; 244/121, 123, 129.1; 118/504, 505; 427/282, 287, 292, 448; 451/29, 445, 451–457; 29/889.1, 889.7, 889.71, 889.72

(56) References Cited

U.S. PATENT DOCUMENTS

| | | | | |
|---|---|---|---|---|
| 1,946,129 | * | 2/1934 | Cebulski | 416/224 |
| 2,292,089 | * | 8/1942 | Reid | 416/224 |
| 4,082,870 | * | 4/1978 | Yenni | 427/425 |
| 4,596,718 | * | 6/1986 | Gruner | 427/295 |
| 5,165,859 | * | 11/1992 | Monroe | 416/224 |
| 5,564,900 | * | 10/1996 | McAuley | 416/62 |
| 5,702,574 | * | 12/1997 | Foster et al. | 118/500 |
| 5,785,498 | * | 7/1998 | Quinn et al. | 416/224 |
| 5,792,267 | * | 8/1998 | Marszal et al. | 118/500 |
| 5,985,122 | * | 11/1999 | Conner | 427/282 |
| 6,037,004 | * | 3/2000 | Zajchowski et al. | 427/282 |
| 6,109,873 | * | 8/2000 | Brooks et al. | 416/62 |

FOREIGN PATENT DOCUMENTS

| | | | | |
|---|---|---|---|---|
| 523788 | * | 8/1921 | (FR) | 416/224 |
| 412300 | * | 6/1934 | (GB) | 416/229 |
| 452841 | * | 8/1936 | (GB) | 416/224 |

* cited by examiner

*Primary Examiner*—Christopher Verdier
(74) *Attorney, Agent, or Firm*—Gene D. Fleischhauer

(57) ABSTRACT

A method and shield assembly 12 for use in processing a flow directing assembly 10, such as a stator vane or rotor blade, is disclosed. Various details are developed for the construction of the shield assembly and for the method of masking the flow directing assembly. The shield assembly has a shield having two sides 52, 56 and at least one tab 56 which extends from one of the sides and through the other side and is pressed against the other side. In one embodiment, the method includes exerting a force against the shield to block movement of the shield from the installed position. The shield assembly might include a locking member for this purpose which has a projection 106*a* which is attached to the shield or a locking member 42 which is not attached to the shield and which has a tab 114 which engages the shield and a projection 112 which engages the airfoil. Alternatively, the shield assembly might include a clamp 92 which presses the shield against the airfoil.

24 Claims, 4 Drawing Sheets

FIG.3A
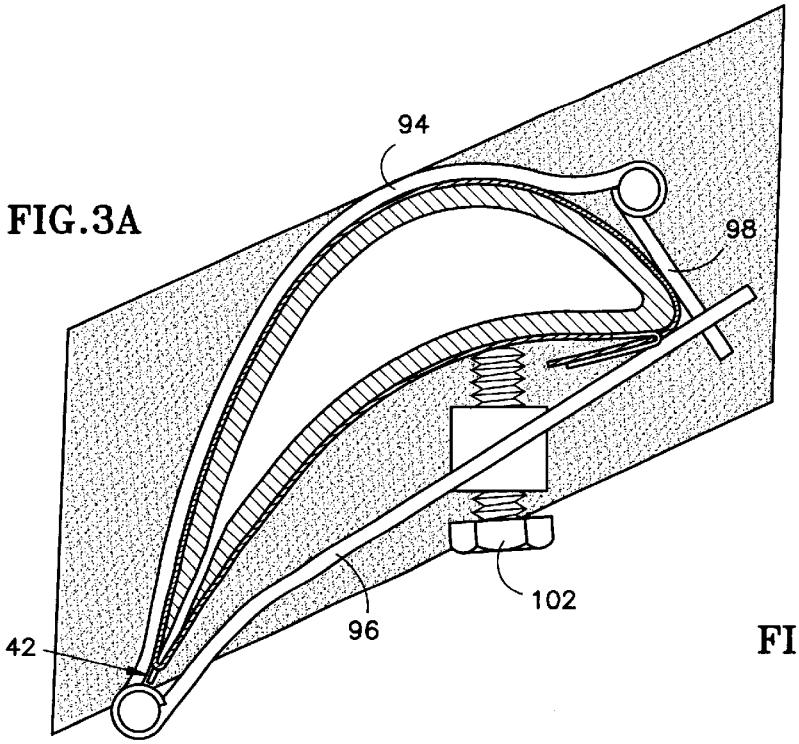
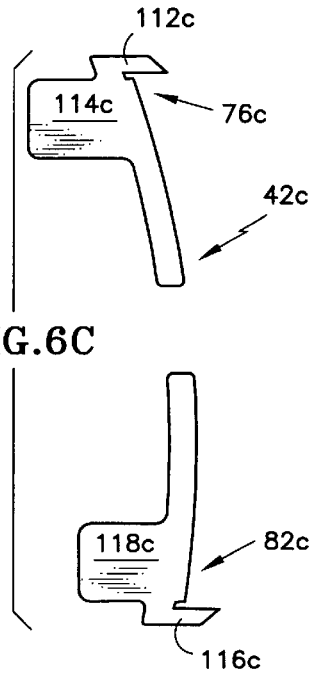
FIG.6C
FIG.6
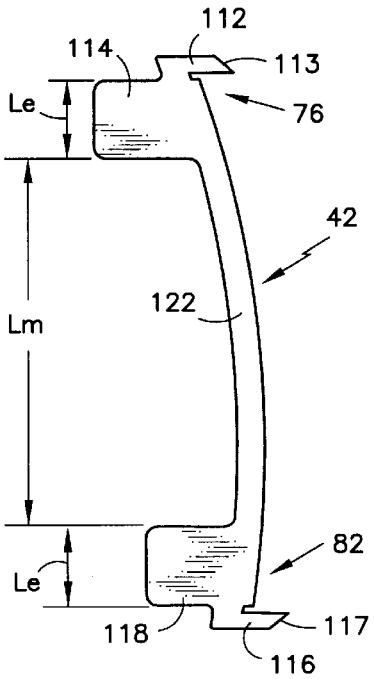
FIG.6A
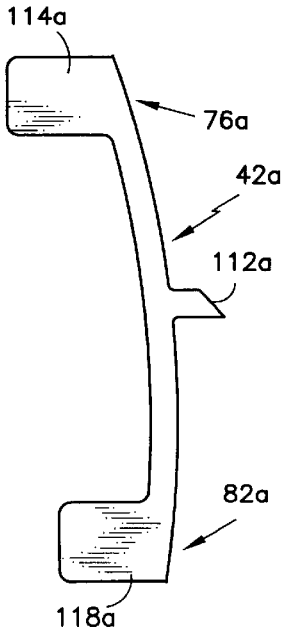
FIG.6B
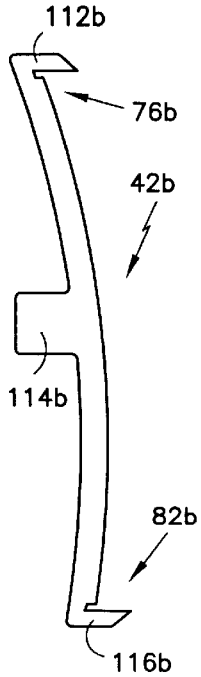

METHOD AND ASSEMBLY FOR MASKING A FLOW DIRECTING ASSEMBLY

This application claims benefit from U.S. Provisional Application Ser. No. 60/089,664 filed on Jun. 17, 1998.

CROSS REFERENCE TO RELATED APPLICATIONS

This application contains subject matter related to the following copending U.S. patent application Ser. No. 08/994,676, filed Dec. 19, 1997, now U.S. Pat. No. 6,037,044, entitled SHIELD AND METHOD FOR PROTECTING AN AIRFOIL SURFACE and commonly assigned to the assignee of the subject application and is related to copending U.S. patent application Ser. Nos. 09/298,379 and 09/298,380, both filed Apr. 23,1999.

TECHNICAL FIELD

This invention relates to a shield for protecting the surface of an airfoil and relates to protecting the airfoil from particles directed at such airfoils.

BACKGROUND OF THE INVENTION

An axial flow rotary machine, such as a gas turbine engine for an aircraft, has a compression section, a combustion section and a turbine section. An annular flow path for working medium gases extends axially through the sections of the engine. A rotor assembly extends axially through the engine. The rotor assembly includes a plurality of rotor blades which extend outwardly across the working medium flow path in the compression section and the turbine section. A stator assembly includes an outer case which extends circumferentially about the flow path to bound the working medium flow path. The stator assembly has arrays of stator vanes which extend radially inwardly across the working medium flow path between the arrays of rotor blades in both the compression section and turbine section.

The rotor blades and stator vanes are flow directing assemblies. Each has an airfoil which is designed to receive, interact with and discharge the working medium gases as the gases are flowed through the engine. Airfoils in the turbine section receive energy from the working medium gases and drive the rotor assembly at high speeds about an axis of rotation. Airfoils in the compression section transfer energy to the working medium gases to compress the gases as the airfoils are driven about the axis of rotation by the rotor assembly.

The airfoils in both sections extend radially across the working medium flow path. The airfoils in the compression section and turbine section are bathed in hot working medium gases under operative conditions. The gases may cause corrosion and unacceptably high temperatures at the surface of the airfoil, especially in the turbine section.

The airfoils in the turbine section are cooled by flowing cooling air through the airfoil. Each airfoil has cooling air holes. The cooling air holes extend from the interior to the exterior of the airfoil. The cooling air holes discharge cooling air and cool the airfoil by convection and by providing film cooling to regions of the airfoil such as the leading edge or the trailing edge.

The turbine airfoil also has protective coatings providing a thermal barrier to heat transfer and to provide oxidation resistance to the airfoil. These coatings are provided to selected regions of the airfoil, such as the platforms of stator vanes, the airfoils and the tips of the airfoil. The coatings may also vary depending on the location in the engine of the flow directing assembly which is coated.

In addition, airfoils in both the compressor section and turbine section extend into close proximity with the adjacent stator structure. The small clearance between these elements of the engine blocks the leakage of the working medium gases around the tips of the rotor blades. As a result, the tips of such airfoils may rub against such structure during transient operation. Alternatively, the tips are designed to cut a groove or channel in such structure. The blades extend into the channel under steady state operative conditions to decrease tip leakage.

The tips of such airfoils are often provided with an abrasive material and are axially aligned with adjacent radial structure which is provided with an abradable material. The combination of an abrasive tip with abradable material spaced radially from the tip enables the structure to accommodate movement of the blades outwardly and to accommodate interference between the tips of the blade and the adjacent structure. This occurs without destruction of the tip of the tip or the stator structure and enables the tip to cut the necessary groove if so required.

The abrasive material may be provided to a substrate at the airfoil tip by many techniques such as powder metallurgy techniques, plasma spray techniques, and electroplating techniques. One example of a plasma spraying device is shown in U.S. Pat. No. 3,145,287 to Siebein et al. entitled: "Plasma Flame Generator and Spray Gun". In Siebein, a plasma forming gas is disposed about an electric arc and passed through a nozzle. The gas is converted to a plasma state and leaves the arc and nozzle as a hot free plasma stream. Powders are injected into the hot free plasma stream and heated. The softened powder is propelled onto the surface of a substrate which receives the coating. Other examples of such devices are shown in U.S. Pat. No. 3,851,140 to Coucher entitled "Plasma Spray Gun and Method for Applying Coatings on a Substrate" and U.S. Pat. No. 3,914, 573 to Muehlberger entitled "Coating Heat Softened Particles by Projection in a Plasma Stream of Mach 1 to Mach 3 Velocity".

The substrate is typically prepared for receiving the particles by cleaning and roughening the surface of the substrate. One technique uses a grit blasting apparatus to propel abrasive particles against the substrate by grit blasting. Portions of the airfoil are masked or shielded with a mask or shield to prevent the abrasive particles from damaging the airfoil and other portions of the blade.

It is preferable to use a shield, for example, for the airfoil surface adjacent the tip which may survive either the impact of abrasive particles or high temperatures of the coating process and block coatings from deposit at unwanted locations. Metal shields extending over several airfoils have been used with a screw fastener for the shield. A metal band having a tab is installed near the tip between the shield and the airfoil to fill the gap between the relatively rigid shield and the airfoil.

Another approach is to use a high temperature material, such as aluminum foil tape, which is suitable for use during the coating process to provide the masking or shielding. The aluminum tape is also suitable for use during the grit blasting operation. The aluminum tape has an adhesive backing which is used to affix the tape to the airfoil. The tape requires precise installation to maintain the correct clearance between the top of the rotor blade and aluminum tape which acts as a mask or shield. If an error occurs in installation, the tape is removed with difficulty because of the adhesive and new tape installed.

The aluminum tape remains in place for both the grit blasting and plasma coating operation. After removal from the grit blasting fixture, the rotor blade is reinstalled in the coating fixture. After receiving the plasma spray coating, the tape and its adhesive are removed, often with difficulty because the adhesive is an integral part of the tape and because it leaves a residue even after the tape is removed. The tape is expensive, labor intensive to apply, labor intensive to remove, and is not reusable.

Accordingly, the above are notwithstanding, scientists and engineers working under the direction of applicants assignee have sought to improve the shields used during the application of coatings to the tips of rotor blades.

SUMMARY OF INVENTION

This invention is in part predicated on the recognition that a shield having tabs for an airfoil may be formed of a thickness of material that is thin enough to allow the material to conform to the suction surface and pressure surface of the airfoil and also have material in the tab region that is thick enough to accept the pulling force of installation and exert a holding force against a faying surface.

This invention is also in part based on the recognition that the shield may shift and not completely protect critical portions of the airfoil from the coating process or not leave exposed to the process other critical locations of the airfoil.

According to the present invention, a shield assembly for masking an airfoil includes a shield disposed about the airfoil and means for blocking movement of the shield from the installed position.

In accordance with one detailed embodiment of the present invention, the means for blocking movement is a locking member which extends into an opening in the airfoil and engages or is part of the shield to block movement of the shield.

In accordance with the present invention, the opening is a cooling air hole in the airfoil and the shield has an opening for receiving the locking member.

In accordance with one detailed embodiment of the present invention, one side of the shield is longer than the other, with the longer side of the shield being split into an upper portion extending chordwisely and a lower portion extending chordwisely to the rear edge, and with the upper portion and the lower portion overlapping one over the other in the spanwise direction over at least a part of the chordwise length.

In accordance with one detailed embodiment of the present invention, the means for blocking movement is a clamp which has a first side and a second side which are attached to each other at the front edge and the rear edge, and includes a member extending from the first side which urges the first side of the shield against the airfoil.

In one detailed embodiment, the locking member is a spanwisely extending member having at least a pair of spanwisely spaced projections each engaging associated cooling air holes in the trailing edge of the blade.

In one embodiment of the present invention, the shield has two chordwise sides joined at a front edge, each side extending from the front edge to a rear edge and joined at the rear edge by a pair of tabs extending from one side of the shield through an opening in the other side and bent over into a faying relationship with the other side.

According to the present invention, a method for masking the flow directing surface of an airfoil while exposing the tip or platforms at both the base and the tip for processing includes disposing about the airfoil a two sided shield having the sides joined at a front edge and tabbed at the rear edges, pulling the tabs past the rear edge through the other side and over the other side and pressing each tab into a faying relationship with the other side to urge the rear edges together; spanwisely positioning the shield with respect to the tip, at any time prior to removing the shield; and, removing the shield by unbending the tabs from the faying side to open the shield.

In one detailed embodiment, the method includes disposing a locking member between the airfoil and the shield and engaging an opening in the airfoil with the locking member.

In accordance with one embodiment of the present method, the step of positioning the airfoil includes leaving a gap G' between the platform of the airfoil and the shield and removing the shield includes sliding the shield spanwise away from the tip into the gap G' prior to the step of removing the shield from the airfoil to avoid destructive interference between the shield and the tip.

A primary feature of the present invention is a shield for an airfoil having a front edge extending spanwise and a locking member for blocking movement of the shield from the installed position. Another feature is the two sides of the shield which extend chordwise. Each side has a rear edge extending spanwise. A primary feature of the present method of installing and removing the shield includes disposing the shield about the airfoil and pulling the tabs past the rear edge and through the other side. Another is pressing each tab of one side into a faying relationship with the other side to urge the other side against the airfoil. Another feature is positioning the shield spanwisely at any time prior to processing the airfoil such as with a locking member. Still another feature is positioning the shield to leave a gap G' between the platform of the airfoil and the shield and sliding the shield into the gap G' after applying a coating to the tip of the airfoil prior to the step of separating the shield from the airfoil.

A primary advantage of the present invention is the speed at which an array of rotor blades or stator vanes may be shielded for a coating process and for surface preparation such as by abrasive blasting. Another advantage is the decreased cost of surface preparation and the coating process which results from the durability of reusable shields as compared with those constructions which require destructive use of such shields. Still another advantage is the quality of the resulting coating which results from the removability of the shield without chipping or scratching of the applied coating.

The foregoing features and advantages of the present invention will become more apparent in light of the following detailed description of the best mode for carrying out the invention and accompanying drawings.

BRIEF DESCRIPTION OF THE DRAWINGS

FIG. 3A is an alternate embodiment of the shield assembly shown in FIG. 2.

FIG. 6 is an enlarged view of the locking member shown in FIG. 1.

FIG. 6A is an alternate embodiment of the locking member shown in FIG. 6.

FIG. 6B is an enlarged view of the locking member shown in FIG. 6.

FIG. 6C is an enlarged view of the locking member shown in FIG. 6.

BEST MODE FOR CARRYING OUT THE INVENTION

Figure 1:
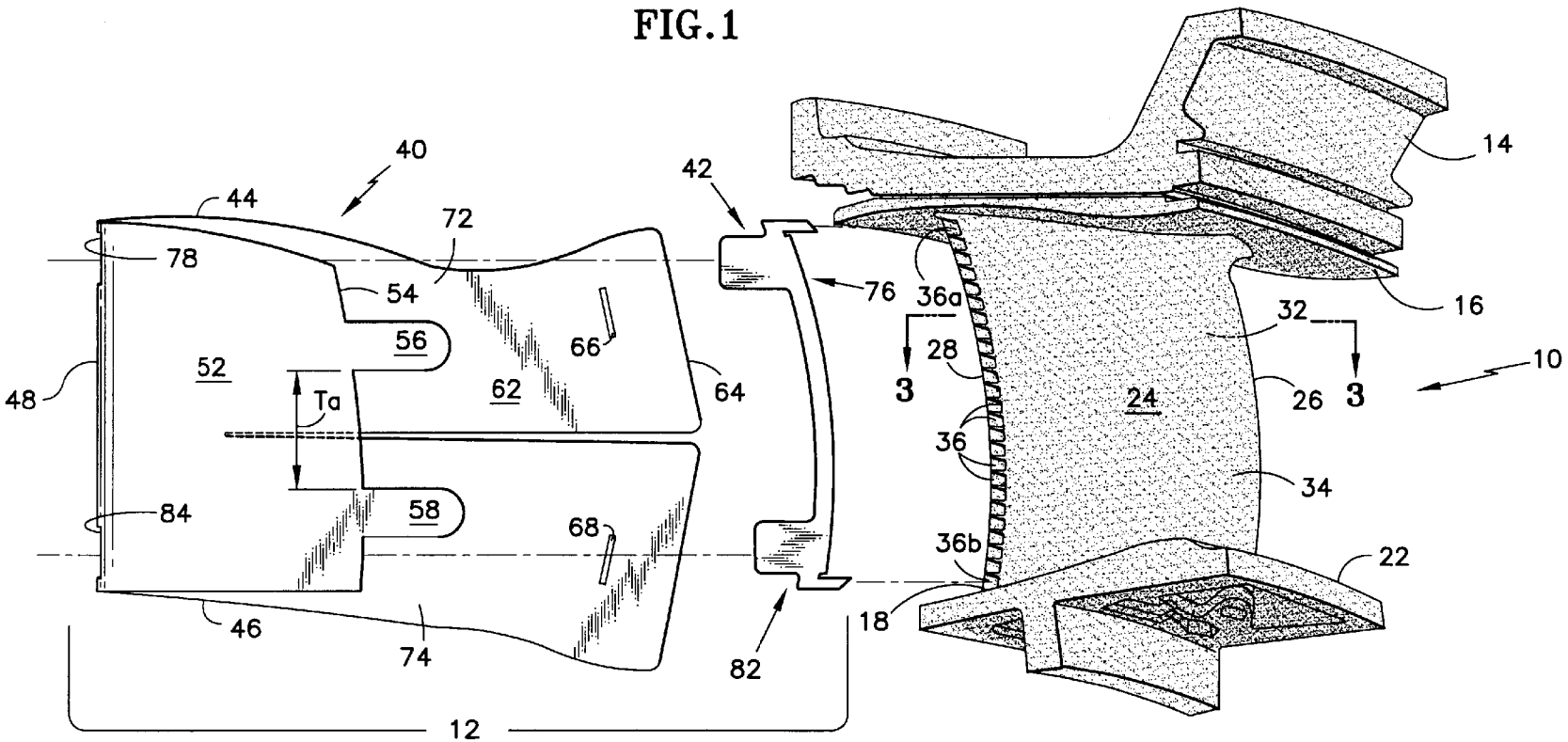
FIG. 1 is a perspective exploded view of a flow directing assembly, such as a stator vane, showing the relationship of the stator vane and shield assembly to each other and in particular showing a locking member and a metal shield having sides which are disposed over the airfoil of the stator vane.

FIG. 1 is a perspective view of a flow directing assembly, such as a stator vane 10, and an associated shield assembly 12. The stator vane has a base end 14 which includes a first platform 16. The stator vane has a tip end 18 having a second platform 22. A flow directing surface, as represented by an airfoil 24, extends from the first platform to the second platform.

Each airfoil has a leading edge 26 and a trailing edge 28. A suction surface 32 and a pressure surface 34 extend between the edges. The leading edge has a plurality of cooling air holes (not shown) and the trailing edge has a plurality of cooling air holes 36. The cooling air holes in the trailing edge are cut back revealing a slightly rectangular portion interrupted by pedestals which extend rearwardly between each cooling air hole. In alternate embodiments, the flow directing assembly might be a rotor blade having a base which has a root and a platform. The airfoil of a rotor blade typically terminates in a tip which, in some embodiments, might include a shroud which is analogous to a platform.

The shield assembly 12 includes a shield 40. In the embodiment shown, a locking member 42 is adapted to extend between the stator vane and the shield. The locking member might be separate from the shield or integrally attached to the shield. The shield is adapted to be disposed about the edge of the airfoil. The shield is formed of a suitable metal which can withstand the impact of the abrasive particles or coating particles and the temperature of any coating spray process. One suitable material is AMC 6513 (Aerospace Material Specification 6513) stainless steel having a thickness of about nine thousandths of an inch to fifty thousandths of inch (0.009–0.050 inches), with nine thousandths of an inch preferable for some applications.

The shield has a first end 44 which is adapted to be in close proximity to the first platform 16. The shield has a second end 46 which is adapted to be in close proximity to the second platform. A front edge 48 extends spanwise between the second end and the first end. A first side 52 extends from the front edge. The first side has a rear edge 54 spaced chordwise from the front edge. A first tab 56 extends from the rear edge at the first end. A second tab 58 extends from the rear edge and is spaced spanwise from the first tab leaving a gap $T_a$ therebetween.

The metal shield has a second side 62 extending chordwise from the front edge. The second side has a rear edge 64 spaced spanwise from the front edge and adjacent to the rear edge of the first side. The second side is longer in the chordwise direction than the first side. The rear edge of the second side is spaced chordwisely from the rear edge of the first side in the installed condition.

The second side has first opening 66 and a second opening 68. Each opening is chordwisely spaced from the rear edge 64 of the second side and closely adjacent the rear edge 54 of the first side in the installed condition. The first opening is at a spanwise location aligned with the first tab 56 and a second opening is at a spanwise location aligned with the second tab 58. The first and second tabs are adapted to extend through the openings in the second side and extend over the first side and in faying contact with the first side of the shield in the installed condition. In the installed condition the tabs extend at a location past the rear edge of the first side and are adapted to exert a force on the first side and the second side to urge the first and second sides into engagement with the side of an airfoil in the installed condition.

Figure 2:
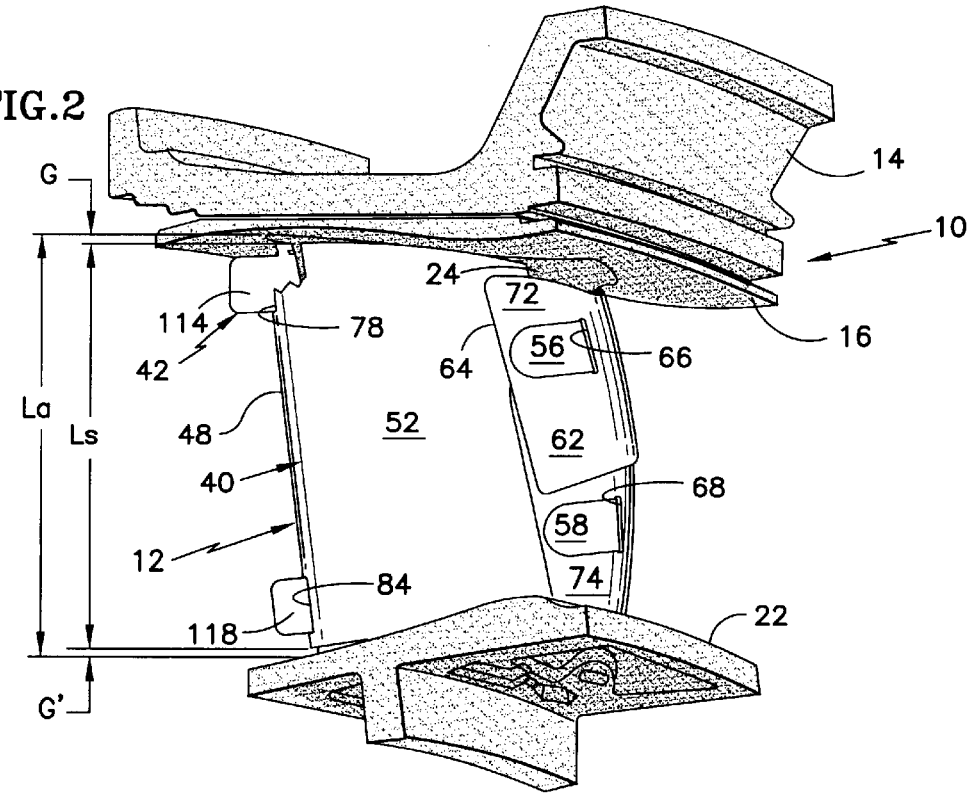
FIG. 2 is an assembled view of the flow directing assembly shown in FIG. 1, having a shield assembly disposed about the stator vane with a portion of the shield broken away to show the locking member.

As shown in FIG. 1, the long second side is split into an upper portion 72 extending chordwisely and a lower portion 74 extending chordwisely. As shown in FIG. 2, the portions are adapted to overlap one over the other in the spanwise direction in the installed condition over at least a portion of their chordwise length.

The locking member 42 has a first end region 76 adjacent the first platform 16. The first end region adapts the locking member to engage a first cooling air hole 36*a* at the trailing edge of the airfoil. The first end region also adapts the locking member to engage in the spanwise direction a first front opening 78 in the shield 44. The locking member has a second end region 82 adjacent the second platform which adapts the locking member to engage a second cooling air hole 36*b* at the trailing edge of the airfoil. The second end region also adapts the locking member to engage in the spanwise direction a second front opening 84 in the shield.

FIG. 2 shows the stator vane 10 shown in FIG. 1 and the shield assembly 12 in the installed condition. As shown in FIG. 2, the long second side 62 of the shield overlaps the first side 52. The upper portion 72 and lower portion 74 of the long second side overlap each other in the spanwise direction. The tabs 56,58 on the first side extend at a location past the rear edge of the second side through the openings 66,68 in the second side. The tabs are bent over into a faying relationship with the second side to urge the second side toward the pressure surface of the airfoil.

The shield is partially broken away in the end region to show the engagement between the locking member 42, the airfoil 24 and the shield 40. The tab 114 of the locking member extends through the first front opening 78 in the shield and restrains the shield against movement in the spanwise direction. The width of the opening is slightly greater than the thickness of the tab and provides for close conformance between the tab and the shield.

Figure 3:
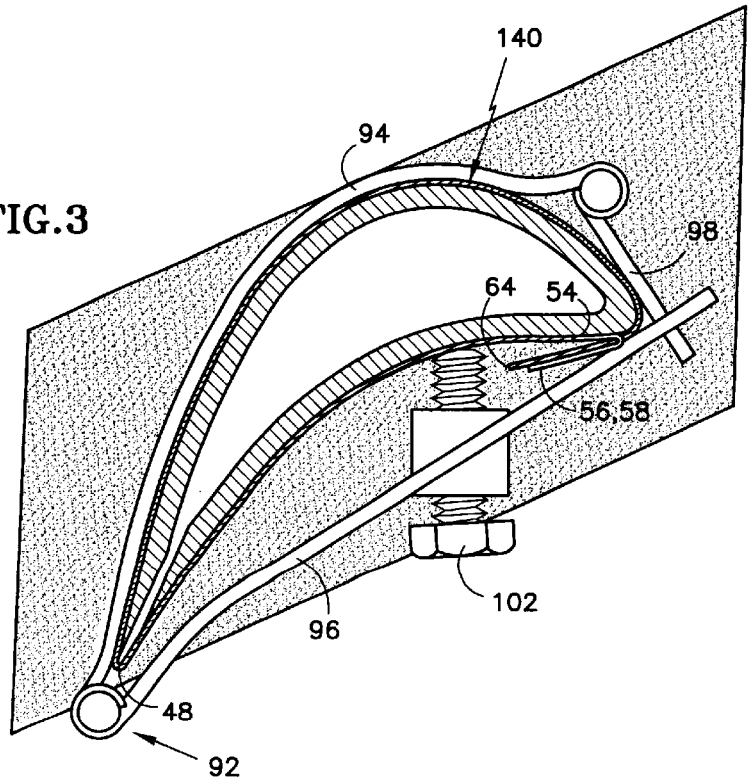
FIG. 3 is a side elevation view of the shield assembly shown in FIG. 2 and is a cross sectional view taken along the lines 3—3 of FIG. 1 showing the relationship of the stator vane and shield assembly to a clamping device for exerting a force on the metal shield and the pressure surface of the airfoil.

FIG. 3 is a cross-sectional view of an alternate embodiment of the shield assembly 12 shown in FIG. 2 having a shield 140. In FIG. 3, the locking member 42 is eliminated. A clamp 92 is disposed about the exterior of the shield. The clamp has a first side 94 and a second side 96. The first side and the second side of the clamp are attached to each other near the front edge 48 of the shield and the rear edge 54 of the first side and the rear edge 64 of the second side 62. The first side of the clamp rotatably engages the second side near the front edge 48 of the shield. At the rear edge of the shield, the first side of the clamp includes a hinged crosspiece 98 which rotatably engages part of the first side and which engages the second side 96. A threaded member, such as a bolt as represented by the bolt 102, threadably engages the second side of the clamp. The bolt presses against the first side of the shield to urge the shield against the airfoil and restrain the shield against spanwise movement. The clamp may also be used with the embodiment shown in FIG. 2 in which case the assembly would include a locking member at the front edge of the shield disposed adjacent the trailing edge of the airfoil as shown in FIG. 3A.

Figure 4:
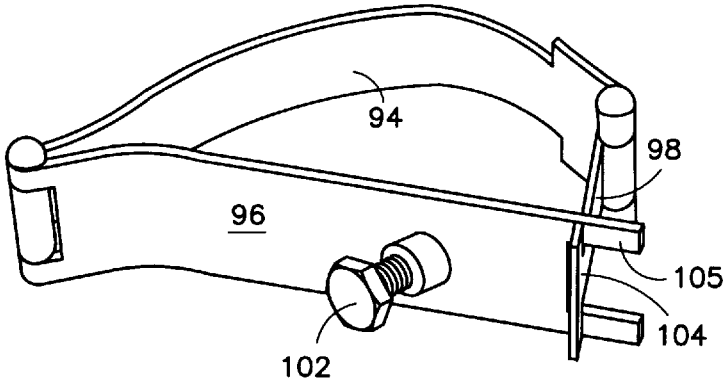
FIG. 4 is a perspective view of a clamp assembly.

FIG. 4 is a perspective view of the clamp assembly shown in FIG. 3 and FIG. 3A. The hinged crosspiece 98 has a T-shape element 104 that engage tangs 105 extending forwardly from the second side.

Figure 5:
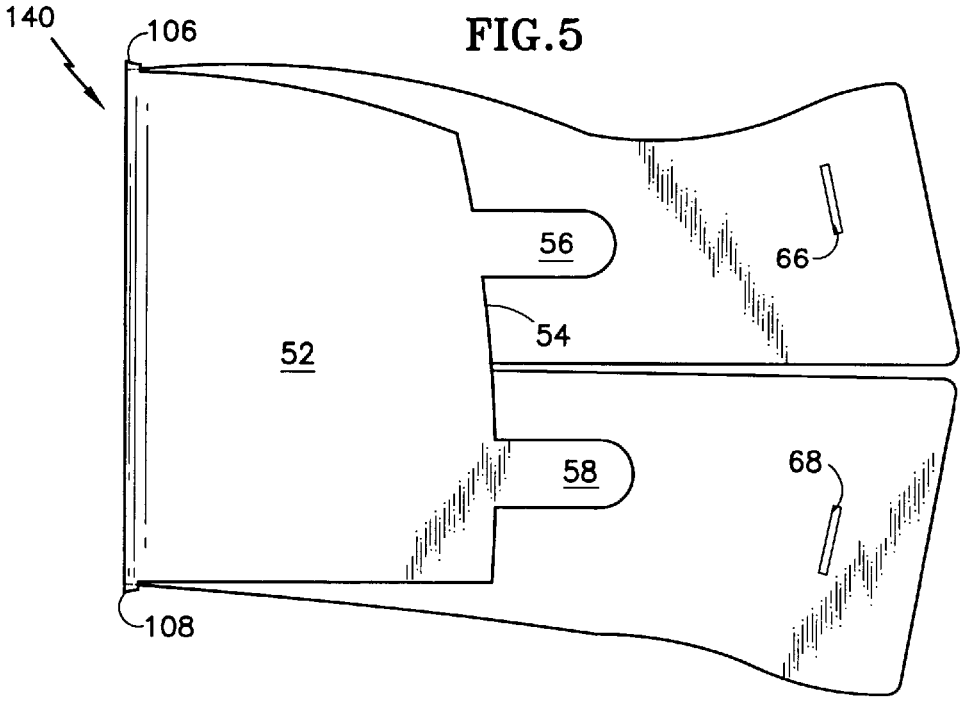
FIG. 5 is a side elevation view of the shield assembly shown in FIG. 3A.

FIG. 5 is a view of the shield 140 shown in FIG. 3A which is an alternate embodiment of the shield shown in FIG. 2. The shield 140 shown in FIG. 5 does not have openings in the front edge of the shield. The shield does not use a locking member of the type shown in FIG. 1 and FIG. 2. Instead, the shield has a first projection 106 at the first end 44 which extends spanwisely from the first end and a second projection 108 at the second end 46 which extends spanwisely from the second end. The projection extends chordwisely to cover the endmost cooling air holes 36*a*, 36*b*. Typically the projection will extend chordwisely less than one-fourth the chordwise length of one of said sides.

Figure 5A:
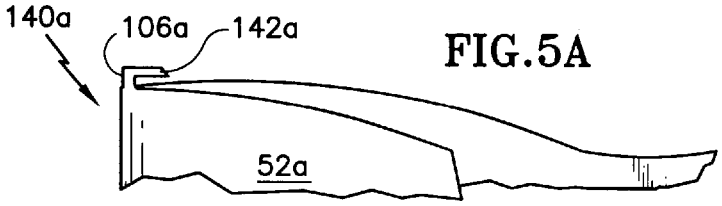
FIG. 5A is an alternate embodiment of the locking member shown in FIG. 5.

Alternatively, the shield may have a locking member 106*a* integrally formed with the shield 140 as shown in FIG. 5A. The locking member is integrally attached to the shield by acting as one piece with the shield, whether it is attached by a bonding technique, integrally formed at the time of manufacture as an appendage, or formed by some other method for forming a structure that acts as one piece. The locking member 106a has a projection 142*a*. The projection shields the end most cooling air holes which are protected when using the locking member by inserting part of the locking members into the holes.

FIG. 6 is an enlarged view of the locking member 42. The first end region 76 has a first L-shaped projection 112 which adapts the locking member to engage the first cooling air hole 36*a* at the trailing edge of the airfoil. The L-shaped projection has a tapered end 113. The L-shaped projection extends in a first direction which is directed generally chordwise and toward the interior of the airfoil. The first end region 76 has a first tab 114 which adapts the locking member to engage the first opening 78 in the shield 40 at the trailing edge 28 of the airfoil. The first tab extends in a direction opposite to the first direction. Similarly, a second L-shaped projection 116 is at the second end region 82. The second L-shaped projection is spaced spanwisely from the first L-shaped projection and adapts the locking member to engage a second cooling air hole 36*b* at the trailing edge of the airfoil. The second L-shaped projection 116 extends in the same direction as the first L-shaped projection toward the interior of the airfoil. The second L-shaped projection has a tapered end 117. The second end region 82 has a second tab 118 which adapts the locking member to engage the second opening 84 in the shield at the trailing edge of the airfoil. The second tab extends in a direction opposite to the first direction.

The locking member includes a spanwise mid region 122 which joins the first end region 76 to the second end region 82. The length of the mid region $L_m$ is greater than four times the length of the tab of the end region $L_e$ and four times greater than the width of the midregion $W_{mr}$, as measured in a direction generally parallel to the extension of the L-shaped projection. The mid-region is generally curved, following the contour of the trailing edge of the airfoil. The shaped projections block movement of the shield to maintain a gap G and G' between the shield and the first and second platforms which exists because the airfoil has a length La between the first platform and the second platform at the tip which is greater than the length Ls of the shield. As will be realized, the L-shaped projections also act as a shield for the endmost cooling air holes 36*a*, 36*b* from particles directed at the airfoil, such as during processing operations or coating operations, and shield surfaces bounding the hole from any coating that might adhere to the interior of the hole as the coating is applied to the airfoil.

Other embodiments of the locking member include an embodiment, as shown in FIG. 6A in which the locking member has a pair of tabs 114*a*, 118*b* which engage a pair of openings in the shield. The locking member has a single projection 112*a* disposed between the tabs which engages a cooling hole in the airfoil. Alternatively, as shown in FIG. 6B, the locking member might have a pair of L-shaped projections 112*b*, 116*b* and a single tab 114*b* which engages the shield. The locking members might also be formed of a pair of locking members 76*a*, 82*c* as shown in FIG. 6C, each having L-shaped projections 112*c*, 116*c* spaced one from the other by a much shorter distance than the mid-region shown in FIG. 6 and each having a single tab 114*c*, 118*c* extending to engage the corresponding opening in the shield. In such an embodiment, the pair of locking members might be spanwisely spaced one from the other and either joined by a length smaller than the length Lm shown in FIG. 6 or not joined by a mid-region.

Prior to applying one of the selected coatings to the airfoil, the locking member 42 is disposed in the cooling air holes 36*a*, 36*b* causing the locking member to act as a shield for the cooling air holes. The shield 40 is disposed about the airfoil. The tabs 56, 58 are inserted through the openings in the second side and pulled rearwardly with a gripping device, such as a pair of pliers, over the second side and pressed tightly against the side in a faying relationship. The shield presses tightly against the flow directing assembly. The shield wraps about the leading edge of the airfoil and about the locking member, trapping the locking member 42 in the chordwise direction. Tabs 114, 118 of the locking member extend through the openings 78, 84 in the front of the shield to block the shield against spanwise movement. The tabs 114, 118 may also be bent over or may just extend rearwardly as shown in FIG. 2. In addition, the clamping device may exert a force against the suction side of the airfoil pressing the shield tightly against the airfoil and the bolt-like member exerts a force against the shield pressing it tightly against the pressure surface of the airfoil. This further serves to lock the shield in place leaving predetermined gaps G and G' between the airfoils in the platform.

A particular advantage of the present invention is the ease of installing a shield to the rotor blade. The ease of assembly facilitates production speed and the shield is reusable.

Another advantage is the integrity of the coating which results from insuring that the coating does not adhere to portions of the airfoil where the coating for the platforms is not wanted. Another advantage is the integrity of a metallic coating provided prior to the coating operation for the platform. This results from using the locking member to restrain movement of the shield and avoiding caulking of the shield with respect to the airfoil which might result in gouging. In those coatings having a large variation in temperature, experience has shown on occasion the projection shown in the alternate embodiment in FIG. 5 may rub against the coating and cause degradation of the metallic coating. Another advantage is the inexpensivness of the shield which results from its inexpensive sheet metal-like construction and the reusability of the shield.

A particular advantage is securing the shield in place using the locking member. The locking member both shields the cooling air hole and locks the shield in place to the airfoil utilizing the cooling holes as a means for restraining the locking member and the shield against movement.

Although the invention has been shown and described with respect to detailed embodiment thereof, it should be understood by those skilled in the art that various changes in form and detail thereof may be made without departing from the spirit and the scope of the claimed invention.

We claim:

1. A method for masking a flow directing assembly of a rotary machine having a flow directing surface, the flow directing assembly having a leading edge, a trailing edge, a base end and a tip end, while exposing a portion of the assembly in the location of at least one of said ends for processing and then unmasking the assembly after processing, comprising:

disposing about the flow directing assembly a shield having a front, a front edge, a rear, a rear edge, two sides, and having the sides joined at the front edge and further having tabs at the rear edge, the shield having an installed position with respect to the flow directing assembly;

pulling at least one tab both through the other side and over the other side, the tab extending with respect to the other side at a point past the rear edge;

pressing each pulled tab into a faying relationship with the other side to urge the sides together;

spanwisely positioning the shield to the installed position with respect to one of said ends at any time prior to removing the shield;

unbending the tabs from the faying side to permit opening the shield; and, removing the shield from the flow directing assembly.

2. The method for masking and unmasking the flow directing surface of claim 1 wherein the method includes exerting a force against the shield to block movement of the shield from the installed position.

3. The method for masking and unmasking the flow directing surface of claim 2 wherein the method includes disposing a locking member adjacent the flow directing surface and engaging the shield with the locking member.

4. The method for masking and unmasking a flow directing surface of claim 3 wherein flow directing assembly has at least one opening and wherein the step of disposing a locking member includes disposing the locking member between the flow directing assembly and the shield and engaging said at least one opening in the flow directing assembly with the locking member.

5. The method for masking and unmasking a flow directing surface of claim 4 wherein the said at least one opening includes at least two openings that are cooling air holes in the flow directing surface spaced one from the other and wherein the step of disposing the locking member includes engaging a pair of spaced apart cooling air holes in the flow directing assembly.

6. The method for masking and unmasking a flow directing surface of claim 4 wherein the locking member has a pair of tabs which are spaced spanwisely and the method includes disposing each tab in an associated opening in the shield and engaging the shield with at least one of the locking member tabs to block the shield against movement.

7. The method for masking and unmasking a flow directing surface of claim 2 wherein said flow directing surface has an applied coating as a result of the processing and wherein the step of positioning the flow directing assembly includes leaving a gap G' between the shield and one of the ends of the flow directing assembly and the step of removing the shield includes sliding the shield spanwise away from the other end into the gap G' prior to the step of removing the shield from the flow directing assembly to avoid destructive interference between the shield and the applied coating at said end of the flow directing assembly as the shield is removed from the flow directing assembly.

8. The method for masking and unmasking a flow directing surface of claim 3 wherein the step of disposing the locking member adjacent the flow directing surface further includes pressing the shield against said flow directing surface to increase the frictional force between the shield and said flow directing surface.

9. The method for masking and unmasking a flow directing surface of claim 8 wherein the step of exerting a force against the shield which includes the step of pressing the shield against the flow directing surface, further includes the step of exerting a force against a side of the shield at a location spaced from the edges of said shield for urging a side of the shield against the surface of the flow directing assembly.

10. The method for masking and unmasking a flow directing surface of claim 9 wherein a hinged clamp has a first side and a second side and wherein the method includes disposing the hinged clamp about the shield, and the step of pressing one side of the shield against the surface of the flow directing assembly includes urging the first side of the clamp against the shield.

11. The method for masking and unmasking a flow directing surface of claim 9 wherein a hinged clamp has a first side and a second side and wherein the second side of the clamp has a member adjustable with respect to the flow directing surface in the installed position and the step of exerting a force against a side of the shield includes adjusting the member to engage the second side of the shield.

12. The method for masking and unmasking a flow directing surface of claim 11 wherein the hinged clamp has a hinged member for engaging both sides of the clamp and wherein the method includes detachably engaging one side of the clamp with said hinged member and rotatably engaging the other to bridge across one edge of the flow directing surface and pressing the hinged member against the shield adjacent the edge region of the airfoil.

13. An assembly for masking a flow directing assembly of a rotary machine during processing of the flow directing assembly at elevated temperatures which would destroy an elastomeric shield, the flow directing assembly having a flow directing surface having a leading edge, a trailing edge, cooling openings, and having a base end and a tip end, while exposing a portion of the assembly in the location of at least one of said ends for processing and then unmasking the assembly after processing, which comprises:

a shield having an installed position with respect to the flow directing assembly which masks the flow directing assembly, the shield being disposed in the installed position about the flow directing surface and having sides which are disposed adjacent the flow directing surface between the leading edge and the trailing edge;

means for blocking the movement of the shield from the installed position during processing at elevated temperatures that would destroy an elastomer and for engaging a separate member, the separate member having at least one opening;

wherein said means extends into the opening and wherein the separate member is separate from the means and is selected from the group of the shield and the flow directing assembly; and, wherein a means for blocking movement of the shield which is attached to the shield engages at least one opening in the flow directing assembly or wherein a means for blocking movement of the shield which is separate from the shield engages at least one opening in the shield.

14. The assembly for masking a flow directing surface of claim 13 wherein the means for blocking movement of the shield includes an element for exerting a force against the shield to press the shield against the flow directing surface.

15. The assembly for masking a flow directing surface of claim 13 wherein the shield has a front, a rear, a first side having a front edge and a rear edge and a second side having a front edge and a rear edge, the sides being joined at the front edge and the sides further having at least one tab on one side adjacent at least one of the rear edges and an associated opening in the other side, the tab extending through the associated opening in the other side and over the other side, at least one of said tabs being disposed in the associated opening and extending with respect to the other side at a point past the rear edge and in a faying relationship with the other side to urge the rear edges together and the sides against the flow directing assembly.

16. The assembly for masking a flow directing surface of claim 15 wherein the means for blocking movement of the shield includes a locking member which is disposed adjacent the flow directing surface and which engages the shield.

17. The assembly for masking a flow directing surface of claim 16 wherein the locking member disposed between the flow directing assembly and the shield engages at least one opening in the flow directing assembly.

18. The assembly for masking a flow directing surface of claim 17 wherein the openings are cooling air holes in the flow directing surface that are spaced one from the other and wherein the locking member engages a pair of spaced apart cooling air holes in the flow directing assembly.

19. The assembly for masking a flow directing surface of claim 17 wherein the locking member has a pair of tabs which are spaced spanwisely and each tab of the locking member is disposed in an associated opening in the shield and engages the shield with at least one of the locking member tabs to block the shield against movement.

20. The assembly for masking a flow directing surface of claim 15 wherein the shield is spaced from one of the ends of the flow directing assembly leaving a gap G' between the shield and one of the ends of the flow directing assembly.

21. The assembly for masking a flow directing surface of claim 15 wherein the means for blocking movement of the shield includes an element for exerting a force against the shield to press the shield against the flow directing surface to increase the frictional force between the shield and said flow directing surface.

22. The assembly for masking a flow directing surface of claim 21 wherein the means for blocking movement of the shield includes a hinged clamp which has a first side and a second side disposed about the shield, and wherein the first side of the clamp is urged against the shield in the installed condition.

23. The assembly for masking a flow directing surface of claim 21 wherein the means for blocking movement of the shield includes a hinged clamp which has a first side and a second side and wherein the second side of the clamp has a member adjustable with respect to the flow directing surface in the installed condition and the member to engage the second side of the shield and exert a force against the second side of the shield.

24. The assembly for masking a flow directing surface of claim 22 wherein the hinged clamp has a hinged member for engaging both sides of the clamp and wherein the hinged member detachably engages one side of the clamp and rotatably engages the other side of the clamp to bridge across one edge of the flow directing surface and presses the hinged member against the shield adjacent the edge region of the airfoil.

* * * * *